US005423636A

United States Patent [19]

Mo

[11] Patent Number: 5,423,636

[45] Date of Patent: Jun. 13, 1995

[54] CEMENT SOIL APPARATUS OF UNDERGROUND BORER

[75] Inventor: Jeon J. Mo, Seoul, Rep. of Korea

[73] Assignee: Kencho Kobe Co., Ltd., Japan

[21] Appl. No.: 83,172

[22] Filed: Jun. 29, 1993

[30] Foreign Application Priority Data

Dec. 10, 1992 [KR] Rep. of Korea ..... 1992-23838

[51] Int. Cl.[6] ..... E02D 5/34

[52] U.S. Cl. ..... 405/266; 405/233; 405/241; 405/269

[58] Field of Search ..... 405/240, 241, 266, 269, 405/267, 232

[56] References Cited

U.S. PATENT DOCUMENTS

| | | | |
|---|---|---|---|
| 3,391,544 | 7/1968 | Daczko | 405/241 |
| 3,793,844 | 2/1974 | Chelminski | 405/248 X |
| 3,800,544 | 4/1974 | Nakanishi . | |
| 4,016,944 | 4/1977 | Wohlfeld | 175/92 |
| 4,084,648 | 4/1978 | Yahiro et al. . | |
| 4,433,943 | 2/1984 | Pao Chen | 405/241 |

FOREIGN PATENT DOCUMENTS

| | | |
|---|---|---|
| 2158764 | 6/1972 | Germany . |
| 55-113786 | 2/1979 | Japan . |
| 55-23272 | 2/1980 | Japan . |
| 55-119885 | 9/1980 | Japan . |
| 4-89916 | 3/1992 | Japan . |
| 2062072 | 5/1981 | United Kingdom . |

*Primary Examiner*—Dennis L. Taylor
*Attorney, Agent, or Firm*—Armstrong, Westerman, Hattori, McLeland & Naughton

[57] ABSTRACT

There is provided a cement soil apparatus of underground borer capable of improving the efficiency of operation such as pile driving in civil engineering foundation work. A screw shaft 3 and a rotary machine 4 for rotating it are disposed on a guide stilt 2 of a vehicle body 1, a down hammer 6 formed with a screw blade 5 is connected to a lower end of the screw shaft, supply conduits 10, 10' and 11, 11' for cement milk or the like are formed in the screw shaft and the down hammer, respectively, such that the supply conduits in the screw shaft are in communication with those in the down hammer, and valves 12, 12' openable by pressure are disposed in lower end portions of the supply conduits, whereby cement or the like can be supplied from the outside to the inside of a bored hole. When boring operation ends and the down hammer is pulled up, cement milk is grouted. Through this, an original form will not be collapsed so as to be kept as it is, and the cement milk is also grouted to part of the original ground below the bored hole to increase the strength of stratum.

3 Claims, 3 Drawing Sheets

CEMENT SOIL APPARATUS OF UNDERGROUND BORER

BACKGROUND OF THE INVENTION

1. Field of the Invention

The present invention relates to a cement soil apparatus of underground borer and a method of forming an underground hole.

2. Description of the Prior Art

Generally, in civil engineering foundation works, construction of board piles (field-made piles) or insertion of P.C piles, H beam piles, steel piles or the like in various kinds of grounds is carried out with the aim of increasing the foundation ground bearing capacity.

In carrying out foundation works as above, when a stratum in which much water springs up, a boulder formation, a conglomerate formation and the like are bored with the conventional working method, a bored hole will collapse in many cases, raising a problem that the aforementioned pile or the like cannot be inserted to a bored depth. Even if a pile can be inserted to a depth of a bored hole, there arises another problem that in some cases, the pile will settle owing to insufficient ground bearing power.

In order to solve the above problems, during execution of field work, operation has hitherto been carried out in which a cylindrical iron pipe is inserted to a bored depth after boring by such a method as pile driving, clay in the cylindrical iron pipe is removed and cement paste is then grouted into the inside of the cylindrical iron pipe, and the cylindrical iron pipe is pulled up by means of a separate crane during curing of cement. Such operation, however, requires a complicated operation process including boring, insertion of the cylindrical iron pipe, cleaning of the inside of the cylindrical iron pipe, grouting of cement and pull-up of the cylindrical iron pipe, thus needing many different apparatus therefor, and because of complexiety of exchange of various apparatus, a great operation cost is needed.

SUMMARY OF THE INVENTION

An object of the invention is to provide a cement soil apparatus of underground borer capable of solving the above conventional various problems.

The present inventor has developed an improved apparatus for smoothly perfoming boring operation in the aforementioned operation and has already filed an application entitled "Underground Borer" (Japanese Utility Model Application No. Hei 3-109630). Essentially, the aforementioned object can be accomplished by laying a cement soil apparatus in the underground borer according to the anterior application.

Essentially, in a cement soil apparatus of underground borer according to the present invention, a screw shaft and a rotary machine for rotating it are disposed on a guide stilt of a vehicle body, a down hammer formed with a screw blade is connected to a lower end of the screw shaft, supply conduits for cement milk or the like are formed in the screw shaft and the down hammer, respectively, such that the supply conduits in the screw shaft are in communication with those in the down hammer, and valves openable by pressure are disposed in lower end portions of the supply conduits.

According to a preferred embodiment of the invention, in a cement soil apparatus of underground borer having a screw shaft and a rotary machine for rotating it which are disposed on a guide stilt of a vehicle body, and a down hammer formed with a screw blade and connected to a lower end of the screw shaft, a hexagonal projection formed at an upper end portion of the down hammer is fitted in a hexagonal hole formed in a lower end portion of the screw shaft and the hexagonal projection is fixedly coupled to the screw shaft by a pin, supply conduits for cement milk or the like are formed in the screw shaft and the down hammer, respectively, such that the supply conduits in the screw shaft are in communication with those in the down hammer, and valves openable by pressure are disposed in lower end portions of the supply conduits, whereby cement milk or the like can be supplied from the outside to the inside of a bored hole.

In a method of forming an underground hole by using the above apparatus, also disclosed in the present invention, boring operation by the down hammer is carried out, and after completion of the boring operation, the down hammer is pulled up while cement milk or the like being supplied to the wall surface of a bored hole to plaster the inner surface of the bored hole with cement milk or the like.

According to the cement soil apparatus of underground borer and the underground hole forming method of the invention, when the down hammer is pulled up after completion of boring operation, cement milk (this is not limitative and, for example, bentonite may be used) can be grouted to prevent collapse of an original form of the bored hole and keep it as it is and besides, the cement milk can be grouted into part of the original ground below the bored hole to increase strength of the ground. Accordingly, after insersion of a pile, frictional force at the periphery of the pile can also be increased to minimize settlement of the pile. At the same time, operation can be very simplified as compared to the conventional operation and therefore a benefical function of drastically reducing the cost of operation can be fulfilled.

DESCRIPTION OF THE PREFERRED EMBODIMENTS

Figure 1:
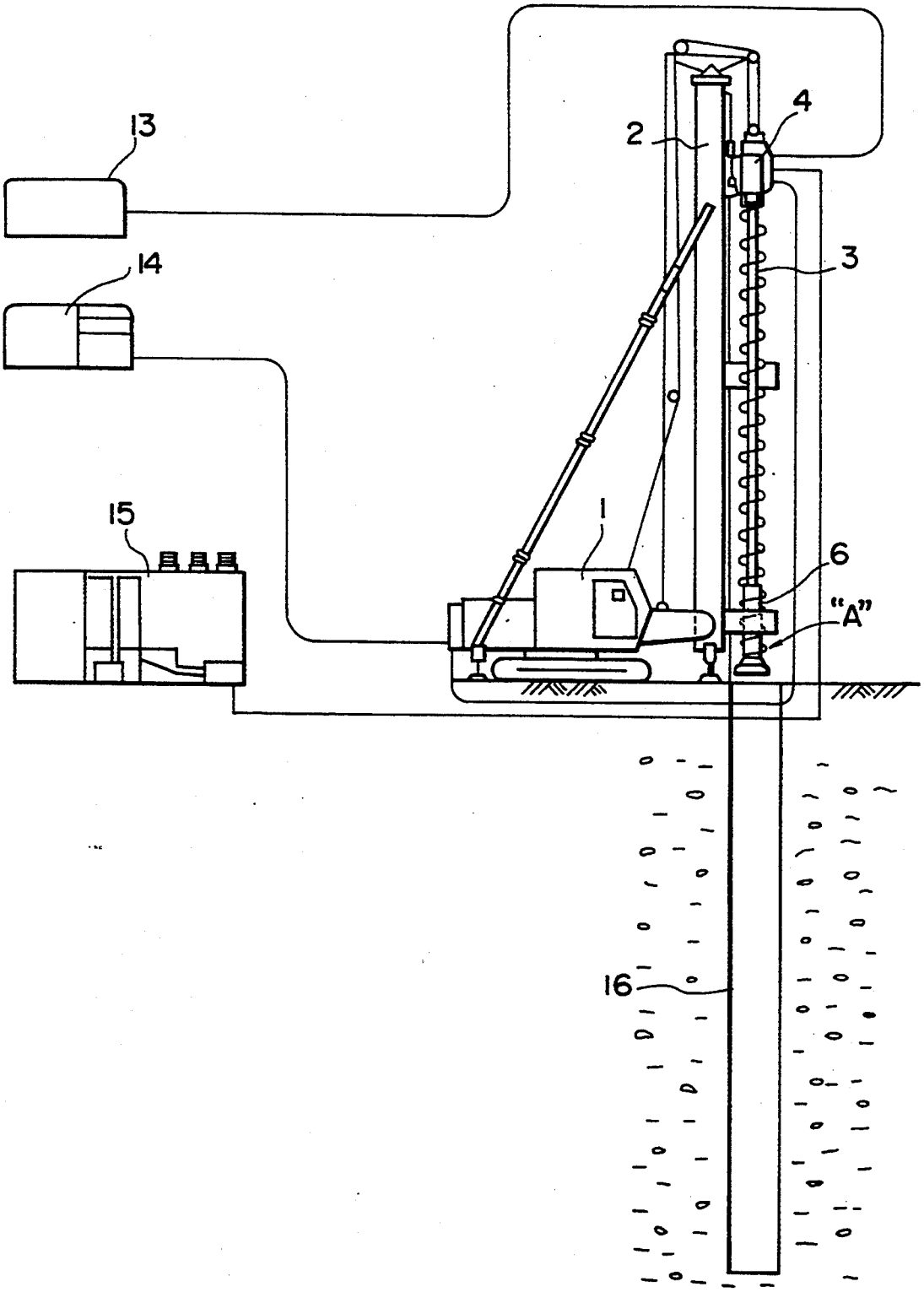
FIG. 1 is a side view showing the overall construction of the invention.
Figure 2:
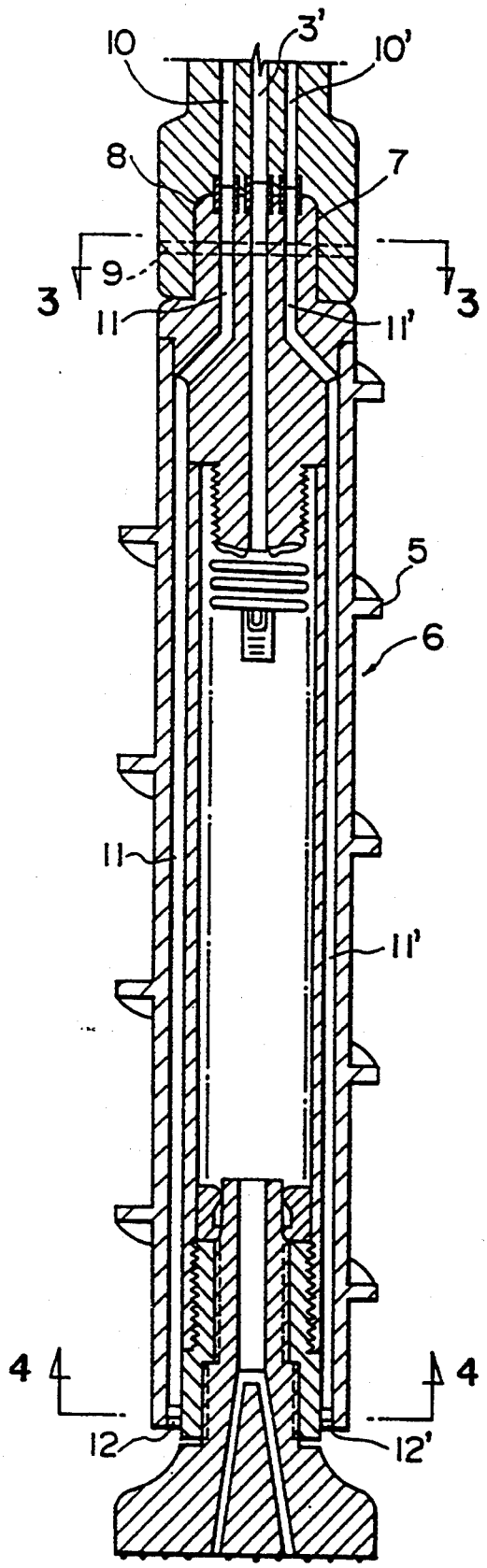
FIG. 2 is an enlarged, longitudinal sectional view of a hammer extracted from A portion of FIG. 1.
Figure 3:
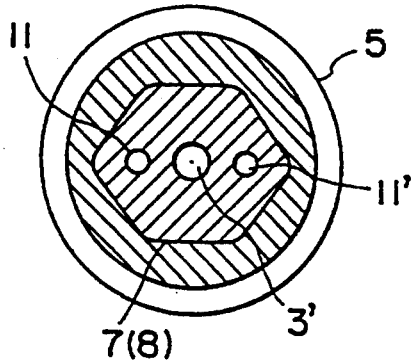
FIG. 3 is a cross-sectional view taken on the line B—B of FIG. 2.
Figure 4:
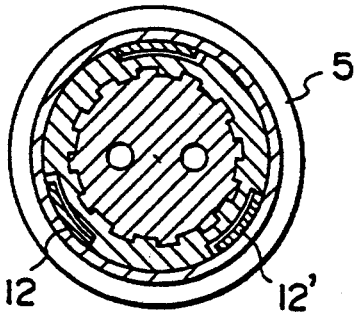
FIG. 4 is a cross-sectional view taken on the line C—C of FIG. 2.
Figure 5:
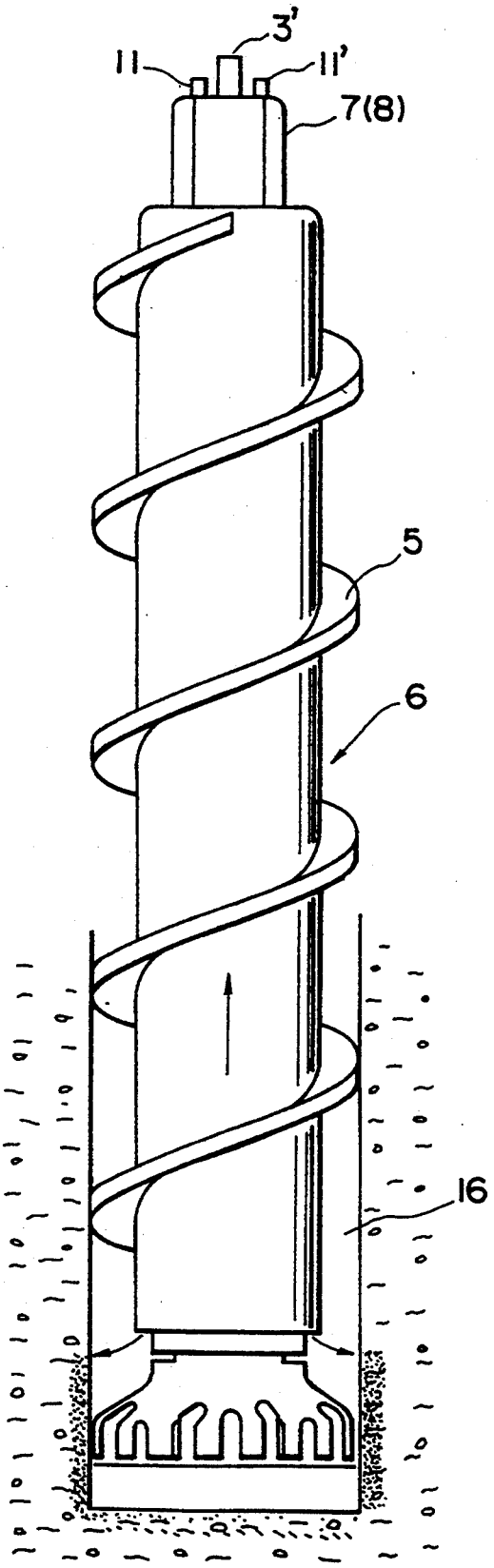
FIG. 5 is a diagram showing an example of a state of cement grouting by the apparatus of the invention.

The invention will now be described by way of example with reference to the accompanying drawings.

A screw shaft 3 and a rotary machine 4 for rotating it are disposed along a guide stilt 2 standing upright in front of a vehicle body 1, and a down hammer 6 formed with a screw blade 5 is connected to a lower end of the screw shaft 3. In this arrangement, a hexagonal hole 7 is formed in a lower end portion of the screw shaft 3, a hexagonal projection 8 is formed at an upper end portion of the down hammer 6, the hexagonal projection 8 is fitted in the hexagonal hole 7, and the hexagonal projection 8 is fixedly coupled to the screw shaft by means of a pin 9.

Further, in the screw shaft 3, a pressurized air supply conduit 3' is bored in the center and cement milk supply conduits 10 and 10' are bored on both sides of the conduit 3' and in the down hammer 6, conduits 11 and 11' in communication with the supply conduits 10 and 10', respectively, are also bored so that cement milk may be dischaged through valves 12 and 12' disposed in lower end portions of the conduits. A channel extending from a cement mixer 13 connects to the cement milk supply conduits 10 and 10' through the rotary machine, and the valves 12 and 12' disposed at the lower end portion of the down hammer 6 are allowed to open only when supply pressure of the cement milk prevails in the conduits 11 and 11'.

In FIG. 1, reference numeral 14 designates a generator, 15 an air compressor and 16 a bored hole.

With the apparatus of the invention constructed as above, the hole 16 is bored by operating the down hammer 6. Slime generated during this operation can be removed readily by means of the screw blade 5 and screw shaft 3 and the hole 16 can be dug to a deeper depth in accordance with the same operation as that of the apparatus described in the aforementioned anterior application.

When the soil property surrounding the hole 16 bored through the above operation corresponds to a atratum in which water springs up, a boulder formation or a conglomerate formation and so the bore will collapse upon pull-up of the down hammer, the down hammer 6 is driven and the cement mixer 13 is operated to supply cement milk to the conduits 10 and 10' and 11 and 11'. The valves 12 and 12' are opened by supply pressure of the cement milk supplied and the cement milk is grouted in the inner columnar surface of the hole 16. At that time, the down hammer in rotation plasters the cement milk to form a cement column and wall and consequently an original form of the hole can be conserved as it is, thereby ensuring that the pile can be inserted readily, frictional force at the periphery of the inserted pile can also be increased by the cement milk inside the hole 16, the strenght of the stratum can also be increased and eventually settlement of the pile can be stopped.

The invention has been described by referring to the embodiment of the cement soil apparatus of underground borer for illustration purpose only, and other many modifications, changes and alternations may be within the framework of the invention. In at least the arrangement set forth so far, the number and size of the cement milk supply conduits can be increased or decreased in accordance with the size and form of a borer, In accordance with the invention, pile driving operation can be simplified greatly as compared to that in the conventional working method and the cost of foundation work can be reduced drastically.

What is claimed is:

1. A cement soil apparatus of underground borer wherein a screw shaft and a rotary machine for rotating it are disposed on a guide stilt of a vehicle body, a down hammer formed with a screw blade is connected to a lower end of said screw shaft, supply conduits for cement milk or the like are formed in said screw shaft and said down hammer, respectively, such that said supply conduits in said screw shaft are in communication with those in said down hammer, and valves openable by pressure are disposed in lower end portions of said supply conduits.

2. A cement soil apparatus of underground borer having a screw shaft and a rotary machine for rotating it which are disposed on a guide stilt of a vehicle body, and a down hammer formed with a screw blade and connected to a lower end of said screw shaft, wherein a hexagonal projection formed at an upper end portion of said down hammer is fitted in a hexagonal hole formed in a lower end portion of said screw shaft and said hexagonal projection is fixedly coupled to said screw shaft by a pin, supply conduits for cement or the like are formed in said screw shaft and said down hammer, respectively, such that said supply conduits in said screw shaft are in communication with those in said down hammer, and valves openable by pressure are disposed in lower end portions of said supply conduits, whereby cement milk or the like can be supplied from the outside to the inside of a bored hole.

3. A method of forming an underground hole by using an apparatus having a screw shaft and a rotary machine for rotating it which are disposed on a guide stilt of a vehicle body, a down hammer formed with a screw blade and connected to a lower end of said screw shaft, supply conduits for cement or the like formed in said screw shaft and said down hammer, respectively, such that said supply conduits in said screw shaft are in communication with those in said down hammer, and valves openable by pressure are disposed in lower end portions of said supply conduits, wherein boring operation by said down hammer is carried out, and after completion of said boring operation, said down hammer is pulled up while cement milk or the like being supplied to the wall surface of a bored hole through said supply conduits and said valve to plaster the inner surface of said bored hole with cement milk or the like.

* * * * *